US007159408B2

(12) United States Patent
Sadegh et al.

(10) Patent No.: US 7,159,408 B2
(45) Date of Patent: Jan. 9, 2007

(54) CHARGE LOSS DETECTION AND PROGNOSTICS FOR MULTI-MODULAR SPLIT SYSTEMS

(75) Inventors: Payman Sadegh, Manchester, CT (US); Mohsen Farzad, Glastonbury, CT (US); Alan M. Finn, Hebron, CT (US); Pengju Kang, Hartford, CT (US); Slaven Stricevic, Willimantic, CT (US)

(73) Assignee: Carrier Corporation, Syracuse, NY (US)

( * ) Notice: Subject to any disclaimer, the term of this patent is extended or adjusted under 35 U.S.C. 154(b) by 162 days.

(21) Appl. No.: 10/900,478

(22) Filed: Jul. 28, 2004

(65) Prior Publication Data

US 2006/0021362 A1 Feb. 2, 2006

(51) Int. Cl.
*F25B 1/00* (2006.01)

(52) U.S. Cl. ..... 62/115; 62/129

(58) Field of Classification Search ..... 62/125, 62/126, 127, 129, 203, 208, 115
See application file for complete search history.

(56) References Cited

U.S. PATENT DOCUMENTS

| | | | | |
|---|---|---|---|---|
| 4,766,553 | A | 8/1988 | Kaya et al. | |
| 5,036,698 | A | 8/1991 | Conti | |
| 5,150,584 | A * | 9/1992 | Tomasov et al. | 62/209 |
| 5,243,829 | A * | 9/1993 | Bessler | 62/126 |
| 5,289,692 | A * | 3/1994 | Campbell et al. | 62/181 |
| 5,335,513 | A * | 8/1994 | Campbell et al. | 62/228.3 |
| 5,481,884 | A * | 1/1996 | Scoccia | 62/129 |
| 5,746,067 | A | 5/1998 | Kramer | |
| 5,860,286 | A * | 1/1999 | Tulpule | 62/129 |
| 6,058,719 | A * | 5/2000 | Cochran | 62/129 |
| 6,293,114 | B1 * | 9/2001 | Kamemoto | 62/129 |
| 6,330,802 | B1 * | 12/2001 | Cummings et al. | 62/129 |
| 6,460,354 | B1 * | 10/2002 | Yabuki et al. | 62/129 |
| 6,571,566 | B1 * | 6/2003 | Temple et al. | 62/129 |
| 6,596,698 | B1 | 7/2003 | Giordano et al. | |
| 6,868,678 | B1 * | 3/2005 | Mei et al. | 62/126 |
| 6,964,173 | B1 * | 11/2005 | Dobmeier et al. | 62/129 |
| 2003/0070544 | A1 | 4/2003 | Mulvaney et al. | |
| 2003/0168389 | A1 | 9/2003 | Astle et al. | |

FOREIGN PATENT DOCUMENTS

DE 4008877 A1 * 10/1991

OTHER PUBLICATIONS

International Search Report dated Aug. 31, 2006.

* cited by examiner

*Primary Examiner*—Mohammad M. Ali
(74) *Attorney, Agent, or Firm*—Carlson, Gaskey & Olds

(57) ABSTRACT

A method for detecting and predicting refrigerant level includes the steps of determining an estimated value for a parameter indicative of refrigerant level and comparing that estimated value to an actual value. The difference between the actual and estimated value provides a refrigerant charge indicator value. The charge indicator value is indicative of the amount of refrigerant contained within the system. A change value is combined with the charge indicator value to provide a prediction for the future value of the charge indicator value. This future value is determined based on a rate of change and charge indicator value over a selected period of time.

18 Claims, 4 Drawing Sheets

CHARGE LOSS DETECTION AND PROGNOSTICS FOR MULTI-MODULAR SPLIT SYSTEMS

BACKGROUND OF THE INVENTION

This invention relates generally to a system for detecting and predicting refrigerant charge levels within a heating ventilating and air conditioning system.

Typically a heating ventilating and air conditioning system (HVAC) includes a refrigerant circuit containing a desired amount of refrigerant. Loss of refrigerant can result in premature failure of HVAC system components. It is therefore desirable to detect and monitor the amount of refrigerant contained within the refrigerant circuit.

Loss of refrigerant typically occurs over time and at a very slow rate. It is desirable to detect the loss of refrigerant and predict a future level of refrigerant in order to optimally schedule maintenance and correction of any problems with the HVAC system.

Known systems for detecting refrigerant loss are capable of detecting a significant loss in refrigerant such that the HVAC no longer functions optimally. However such systems only measure current refrigerant levels, and do not predict future levels of refrigerant to prevent a system from reaching a level where the loss of refrigerant requires immediate attention.

Current known systems for detecting refrigerant level include the use of additional sensors distributed throughout the refrigerant system or the use of complex analytical techniques that diagnose data obtained from sensors. The use of additional sensors is costly, adds complexity and is therefore not desirable.

Other known systems gather large amounts of data and utilized statistical techniques for analysis. Statistical techniques require the gathering of statistically significant levels of data that are often difficult and cumbersome to manipulate. Further, statistical techniques that analyze large quantities of data are most applicable to systems where data is plentiful but the physical properties and operation of the system are not well known. However, in a HVAC system the exact opposite condition is present. That is the physical operation and relationship between parameters of the HVAC system are well known, while the large amounts of data are not normally readily available.

Accordingly it is desirable to develop a system for detecting refrigerant level and for predicting a future level of refrigerant for an HVAC system without the use of additional sensors or gathering prohibitive amounts of data.

SUMMARY OF THE INVENTION

This invention is a method and system for detecting the current level of refrigerant within a HVAC system and for predicting a future level of refrigerant.

The method of this invention includes the steps of determining a charge indicator based on the difference between an actual value and an estimated value of a parameter providing an indication of charge within the HVAC system. A charge indicator is obtained by comparing the actual measured value of a parameter indicative of refrigerant level to the estimated value.

The estimated value is obtained from a predetermined relationship. Between specific selected operating parameters of the HVAC system and a single parameter that is indicative of refrigerant level. An example of such operating parameters includes discharge pressure, refrigerant mass flow and fan speed. The operating parameters are related to operation of an expansion valve according to a regression model using recorded data from the system. The expansion valve includes an opening that is proportionally opened or closed a desired amount based on a number of pulse counts. The number of pulse counts corresponds to the opening size within the expansion valve and is indicative of refrigerant level within the HVAC system.

The relationship between discharge pressure, refrigerant flow, fan speed and expansion valve pulse count provides for the estimation of an expected number of pulse counts for the expansion valve given the current conditions. This reflects the current number of pulse counts that the expansion valve should be at for a system with a full refrigerant charge. This estimated number of pulse counts is compared to an actual number of pulse counts for the expansion valve. The difference between the estimated and actual number of pulse counts provides an indication of the current level of refrigerant within the system.

This invention also includes a method of determining the level of refrigerant charge using principal component analysis. Simulations are performed for different operating conditions at full and low refrigerant charges. The difference between a single operating parameter at full and low refrigerant is utilized to obtain a value indicative of system response to specific operating condition. This value is compared to a value representing actual conditions to determine the current level of refrigerant.

This invention also includes a method for determining a future value of refrigerant level based on the current level of charge. The future value of refrigerant is determined by applying a change value that is indicative of the rate of change of the refrigerant level. This change value can be either a predetermined value or a value determined based on data gathered during operation of the system.

Accordingly, the system and method of this invention provides a means of determining a current refrigerant level and determining and predicting future values for the refrigerant level.

These and other features of the present invention can be best understood from the following specification and drawings, the following of which is a brief description.

DETAILED DESCRIPTION OF THE PREFERRED EMBODIMENT

Figure 1:
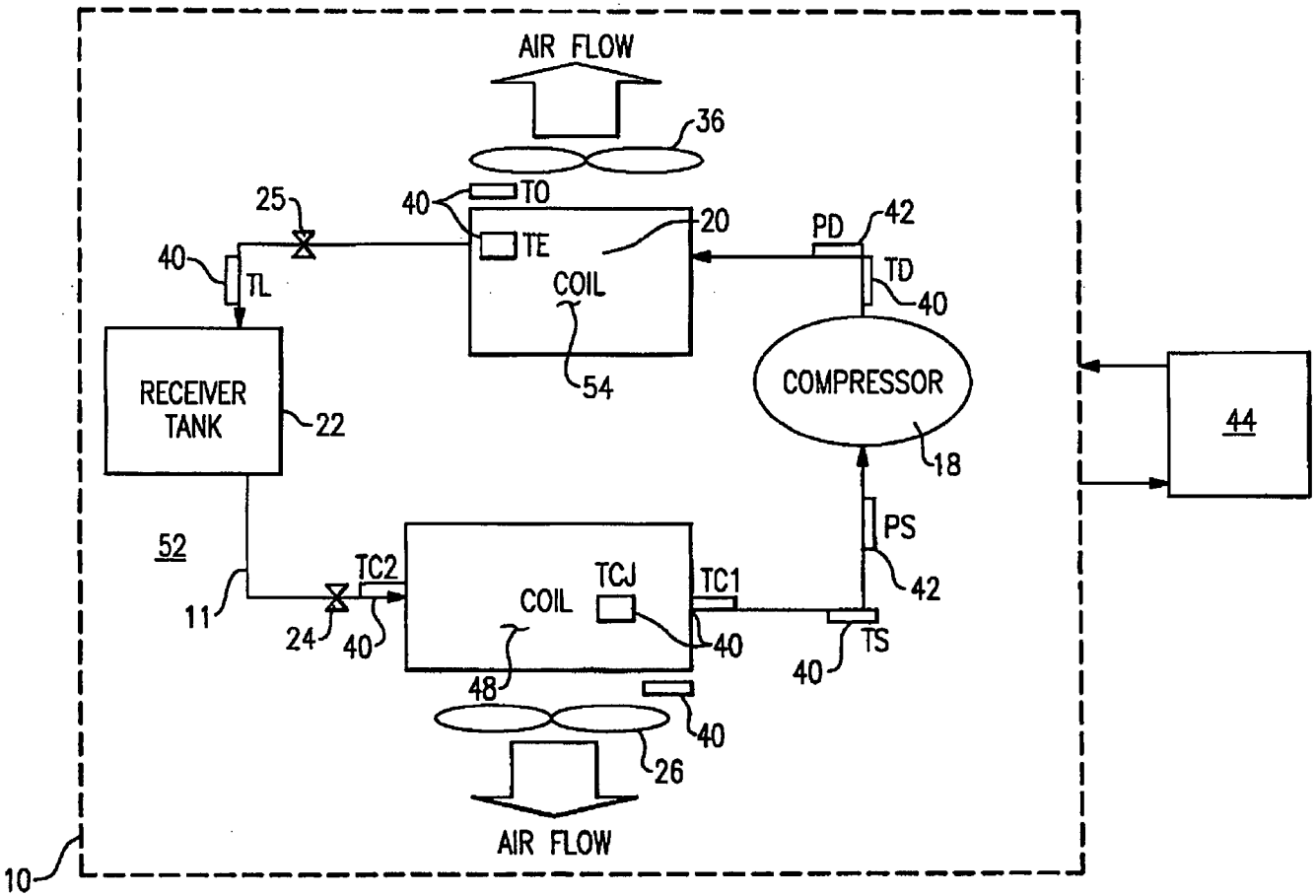
FIG. 1 is a schematic diagram of a vapor compression heating, ventilating and air conditioning system according to this invention.

Referring to FIG. 1, a vapor compression heat pump system 10 includes a first coil 48 and second coil 54. A refrigerant circuit 11 includes a desired amount of refrigerant that flows between the first coil 48 and the second coil 54. The first coil 48 and the second coil 54 are an evaporator and a condenser respectively if the flow of refrigerant is counterclockwise in the refrigerant circuit 11. The first coil 48 and the second coil 54 are a condenser and an evaporator respectively if the flow of refrigerant is clockwise. A compressor 18 compresses air from the evaporator side to the condenser side. A first expansion valve 24 and a second expansion valve 25 control refrigerant flow through the coils 48 and 54. The system 10 includes a liquid reservoir 22 for storing liquid refrigerant. The first coil 48 has a fan 26 and the second coil 54 has a fan 36.

The system 10 can operate in either a heating mode or a cooling mode depending on the refrigerant flow direction. Speeds of a compressor 18 a fan 26 are adjusted to provide a desired temperature in accordance with a temperature set point. The system 10 includes a plurality of temperature sensors 40 and pressure sensors 42. Each of the sensors 40, 42 communicates to a controller 44. The controller 44 accumulates and processes data from the pressure and temperatures sensors 40,42 to adjust operation of the fans 26, 36 compressor 18, and expansion valves 24, 25.

The amount of refrigerant disposed within the refrigerant circuit 11 is proportional to the total volume of liquid refrigerant. Therefore when a low charge refrigerant condition occurs, the total volume of liquid refrigerant drops. A reduction in the amount of liquid refrigerant is first noticeable at points where phase transition occurs between liquid and vapor refrigerant. These transition points occur in the heat exchangers and occasionally in the receiver tank 22.

When the system 10 is in cooling mode, a drop in refrigerant will result in an overall increase of vapor refrigerant as compared to liquid refrigerant. The increased amount of vapor refrigerant typically causes an increase in superheat and a decrease in subcool. Superheat refers to an increase in refrigerant temperature above a boiling point at the outlet of an evaporator. Sub cool is a decrease in refrigerant temperature below the boiling point at the outlet of a condenser.

The flow of refrigerant and thereby the superheat or sub cool condition is controlled by actuating the expansion valve 24. The expansion valve 24 is controlled by pulse modulation. A number of current pulse counts are provided to the expansion valve 24 to control refrigerant flow. The number of pulse counts is increased in a superheat condition relative to the number of pulse counts for a refrigerant circuit 11 when fully charged. Further, in a sub cool condition the number of pulse counts is decreased below what is normal in order to trap more liquid refrigerant within the heat exchanger. Accordingly, the number of pulse counts used to actuate the expansion valve 24 provides an indication of the level of refrigerant.

Figure 2:
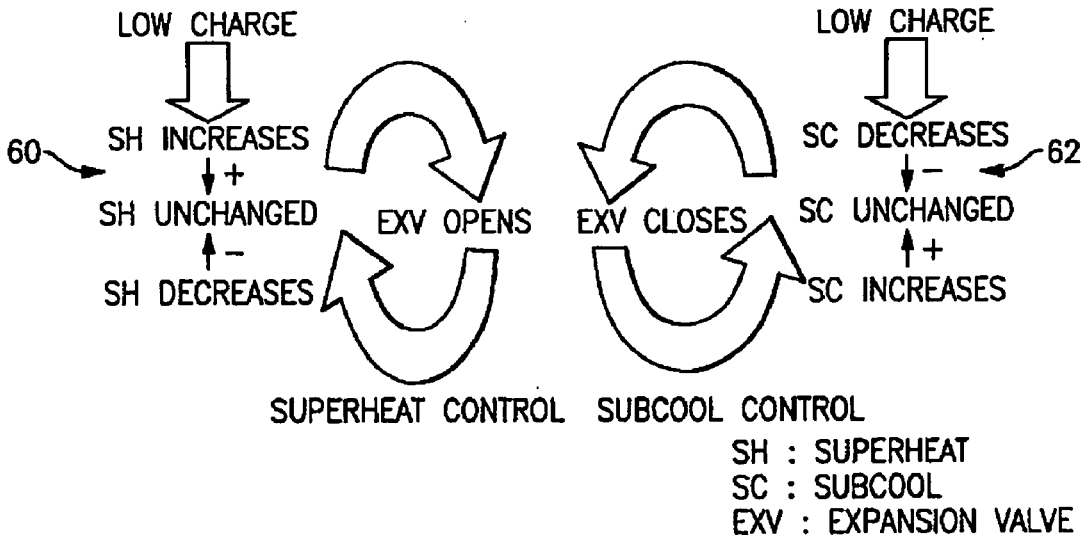
FIG. 2 is a symbolic representation of the operation of the expansion valve for low charge refrigerants.

Referring to FIG. 2, a diagrammatic representation of expansion valve operation is shown. For a super heat condition, (indicated as SH in FIG. 2) the expansion valve pulse count is increased, as indicated at 60, to allow more liquid refrigerant into the heat exchangers to maintain a desired refrigerant temperature and pressure. In a sub cool condition (indicated as SC in FIG. 2), the pulse count for the expansion valve 24 is reduced, as indicated at 62, to trap additional refrigerant within the heat exchanger. Accordingly, in a superheat condition the pulse count for the expansion valve 24 is increased above the pulse count for a fully charged refrigerant system, and for a sub cool condition the pulse count is decreased below the normal pulse count for a fully charged refrigerant system.

Figure 3:
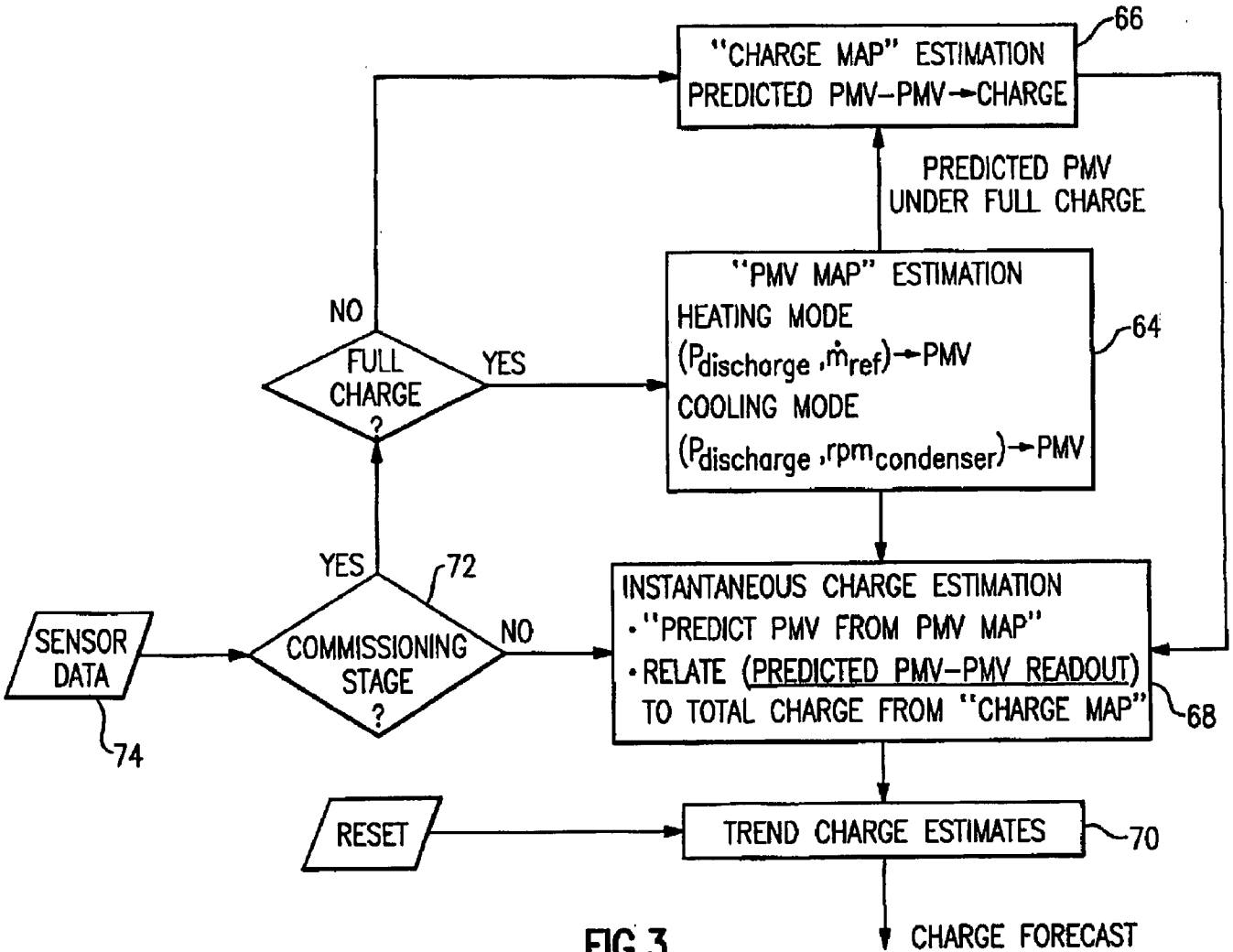
FIG. 3 is a flow diagram of the method of detecting and predicting refrigerant charge for this invention.

Referring to FIG. 3, the method of this invention includes the steps of detecting refrigerant level by first estimating a parameter that is indicative of the current refrigerant level. Preferably, the parameter utilized as an indication of the current refrigerant level is the number of pulse counts for the expansion valve 24. The method includes the step of predicting the number of pulse counts for the expansion valve 24 for current system operating conditions. The expected number of pulse counts is predicted utilizing a regression model.

Regression models utilize data representing system operation to derive a relationship between system parameters. The derived relationship is then used to determine a desired parameter. The specific data that is used to derive the relationship is selected according to a weighting factor that provides an indication of the accuracy in the correlation between the variables within the system and the predicted parameter.

The number of pulse counts of the expansion valve 24 provides a value indicative of refrigerant level. The variables used to predict the number of pulse counts include refrigerant discharge pressure, refrigerant mass flow and fan speed. Values for these system parameters are utilized within the regression analysis to determine a relationship that provides the estimation of an expected number of pulse counts for a full refrigerant charge condition. Although the refrigerant discharge pressure refrigerant mass flow and fan speed are utilized as parameters to predict and provide a relationship to pulse counts, it is within the contemplation of this invention to use other values indicative of system operation. As appreciated the accuracy of the regression model can be improved by constantly analyzing and updating the weight and correlation between parameters used to determine the relationship with the number of pulse counts.

The relationship that is determined using the regression model is utilized to determine an estimated value. This estimated value represents the expected number of pulse counts for the expansion valve 24 for a system having full refrigerant level. Actual measured data is utilized to estimate what the current number of pulse counts should be for the given conditions with a full refrigerant charge. The actual number of pulse counts is compared to the estimated value of pulse counts as is indicated at 66. A difference between the actual value and the estimated value provides a value used as a charge indicator. Preferably, for a refrigerant system with a full refrigerant charge, the difference between the estimated value and the actual value will be zero or very close to zero. An increase in the difference between actual and estimated values is indicative of the loss of refrigerant.

Another approach according to this method for calculating and determining the charge indicator uses a principal component analysis technique. The component analysis technique utilizes data of system parameters to map system reaction. Data gathered from system parameters as measured by sensors 40,42 throughout the system illustrates the reaction of the system to different operating conditions. The different operating conditions include operation at different ambient temperatures and temperature set points. The data is obtained either through experimental operation or simulations. Other system operating conditions can also be used to map system 10 operation and reaction.

System reaction is mapped by measuring operating conditions such as temperatures and pressure for full and low refrigerant charge conditions. The data obtained at a desired operating condition, at full and low refrigerant levels comprises a data pair. This data pair is compared to one another to determine a difference value. The difference value is a vector differential value. Each of these vector differential values for each measured data point is used to compile a matrix.

The matrix can be formed either by horizontal placement by column vectors or vertical placements of row vectors. A singular vector on the largest singular value of this matrix is then computed. The charge indicator is computed by collecting the sensor readouts in the same order as measured. The expected values of all the sensor readouts under full charge are calculated according to the regression model as indicated above. A residual vector is then calculated by subtracting the expected sensor readouts from actual readouts. The dot product of the residual vector and the singular vector provides the value of the charge indicator. The dot product of the residual vector provides a scalar quantity that is used as a charge indicator.

This approach uses the vector values to provide a directional bias for different deviations from the expected value. Directional bias information provides additional data and additional information on a direction of change of the system. The directional information on refrigerant loss provides an indication of the rate at which a change occurs.

The two approaches for determining the charge indicator value are used interchangeable in this method. The evaluation and detection of refrigerant level begins with the gathered sensor data as is indicated at 74. The sensor data includes temperature, and pressure data, along with fan speed and other data within the system. Preferably, the amount of sensor data utilized for the regression analysis is kept to a minimum to reduce complexity.

The data utilized for the pulse count estimation step 64 includes discharge pressure and refrigerant mass flow when the system is in heating mode. When the system 10 is in cooling mode the variables used are discharge pressure and fan speed for the condenser. As appreciated, different variables may be utilized to estimate the variable indicative of refrigerant level.

Once data has been gathered as indicated at 74, a commissioning step 72 can be initiated. The commissioning step 72 performs a calibration where the regression relationship between operating parameters in the system 10 and the expansion valve 24 is confirmed and optimized. The commissioning stage 72 is performed according to a preset schedule, or manually initiated at start up, or during maintenance.

The actual operating parameters from the system are than used to determine an estimated value for the number of pulse counts at step 64. Either the regression approach or the component analysis approach is used to determine the estimated value. The estimated value from step 64 is then compared to the actual number of pulse counts, to determine the charge value as indicated at step 66. The charge value determined in step 66 is used to determine an instantaneous charge estimation 68.

The simulation results are represented using instantaneous charge estimates, step 68. The instantaneous charge estimate does not account for trends or patterns in the level of refrigerant. Trending and determination of a future value of the charge estimate is determined separately as indicated at 70 from the instantaneous charge estimate 68 so that the accuracy of each data point can be evaluated.

In the trending step 70, the charge indicator is combined with a rate of change value to predict a future value of the charge indicator. Forecasting the future value of the charge indicator is accomplished by applying the change value to the instantaneous estimates for the charge indicator value.

A global picture of the movements of the parameter value that enables us to provide an accurate and useful forecast of future values of the charge indicator is obtained by combining the estimate through an appropriate trending technique. Preferably, a Kalman filter is used to provide a measure of data trending, however it is only one of many known trending techniques within the contemplation of this invention. The Kalman filter utilizes current data along with change parameters to provide a future estimate for the level of refrigerant. The current estimated refrigerant level and a future value according to the Kalman filter are related to each other according to the equations:

$$v(t)=[1-\alpha(t-1)]v(t-1)$$

$$\alpha(t)=\alpha(t-1)+m+\epsilon(t)$$

$$\bar{v}(t)=v(t)+e(t)$$

Where v(t) is the parameter of interest (the refrigerant charge indicator) at time t; $\alpha(t)$ is a rate of change in the parameter value at the time t; m is the average rate of change in $\alpha(t)$; and $\bar{v}(t)$ is the estimate of the variable charge based on data acquired at time t. The added term $\epsilon(t)$ is called an innovation process in Kalman filter terminology. This allows deviations from the model and enables adaptation to changing degradation rates if the sensor data point in a certain direction. The sensor data at each time provides the estimated data for the future value parameter of interest and smoothes out noisy estimates or random terms.

Figure 4:
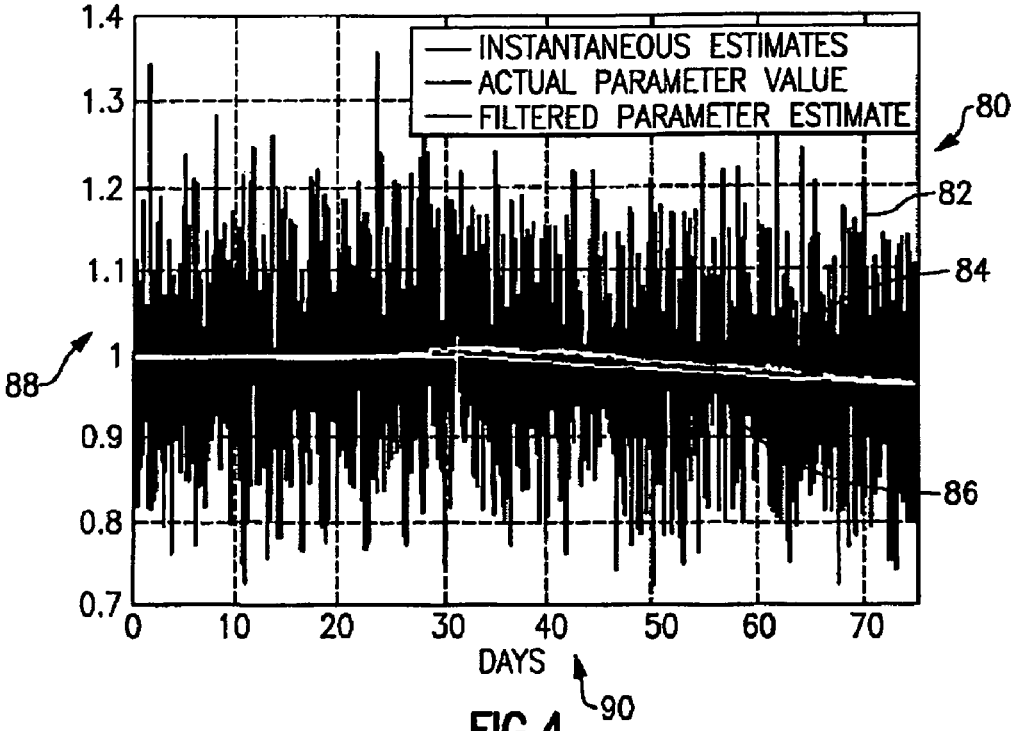
FIG. 4 is a graph illustrating the relationship between instantaneous estimates and filtered estimates.

Referring to FIG. 4, graph 80 illustrates the smoothing of noisy estimates. The instantaneous estimates 82 include wide variations as compared to the actual refrigerant charge level 84 and the filtered charge estimates. The change in parameter value is simulated by the random instantaneous estimates 82 for the charge indicator.

Figure 5:
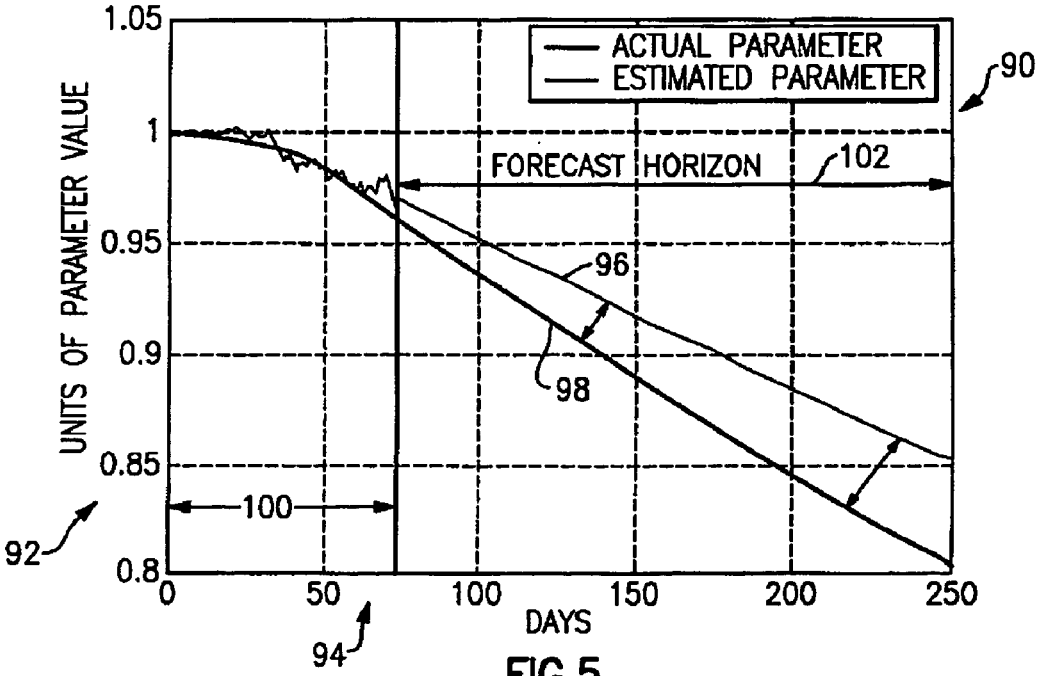
FIG. 5 is a graph illustrating forecast of future refrigerant levels.

Referring to FIG. 5, graph 90 illustrates the refrigerant charge value 92 over time 94 for the actual charge level 98 as compared to the estimated charge level 96. The current time period 100 includes actual estimates compared to actual data. A forecast horizon 102 includes forecast lines were the change value is applied to both the actual data and the estimated data. The increasing distance between the two lines illustrates the accuracy of utilizing the estimated values of refrigerant charge for predicting future values. As appreciated, this graph 90 only provides an example of the relationship between future values that are predicted based on actual charge levels, and future values that are predicted based on estimated charge levels.

The method of this invention provides instantaneous charge estimates and uses a trending technique to connect the estimate and provide a forecast of a future value. The instantaneous estimates are provided by a regression model that maps this charge pressure together with condenser fan speed and refrigerant outdoor mass flow to predict outdoor unit expansion actuator pulse count values. The difference between the predicted number of pulse count values and the actual pulse count values is mapped to provide a model of system charge. Prediction of future values is achieved to predict and incorporate prior information about the rate of change of refrigerant level as a function of time. This provides an adaptable technique for detecting the rate of change of refrigerant charge over time.

This system method provides a simple effective means of determining current refrigerant charge level and predicting the future values for refrigerant charge allowing for the optimal scheduling of maintenance for a heating ventilating and air conditioning system.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of detecting refrigerant level within a refrigerant system comprising the steps of:

a) estimating a value of a parameter indicative of a current refrigerant level by determining a regression model between system parameters and the parameter indicative of the current refrigerant level at a full refrigerant level and estimating the value of the parameter indicative of the current refrigerant level based on said regression model;

b) measuring an actual value of the parameter; and c) determining a charge indicator based on a difference between the actual value and the estimated value, wherein said charge indicator represents the level of refrigerant within the system.

2. The method as recited in claim 1, comprising the step of determining a loss of refrigerant for a value of the charge indicator below a desired threshold.

3. The method as recited in claim 1, wherein said system parameters utilized for formulating said regression model comprise refrigerant discharge pressure and refrigerant mass flow.

4. The method as recited in claim 1, wherein said system parameters utilized for formulating said regression model comprises refrigerant discharge pressure and fan speed.

5. The method as recited in claim 1, wherein said parameter indicative of refrigerant level comprises a value indicative of an expansion valve opening size.

6. The method as recited in claim 5, wherein said value comprises the number of current pulses counts.

7. The method as recited in claim 1, comprising the step of predicting a value of the charge indicator at a future time based on the current value of the charge indicator and a change value representing rate of change of the charge indicator.

8. The method as recited in claim 7, comprising the step of assigning a confidence value to the predicted charge indictor value.

9. The method as recited in claim 8, comprising monitoring actual parameter values and adjusting said change value based on said monitored sensor values.

10. A method of detecting refrigerant level within a refrigerant system comprising the step of:

a) estimating a value of a parameter indicative of a current refrigerant level by determining parameter values for different system operating conditions for a low refrigerant level and a full refrigerant level, determining a difference between parameter values at low and full refrigerant levels for each system operating condition, and determining a vector quantity representing system reaction to various operating conditions;

b) measuring an actual value of a parameter; and c) determining a charge indicator based on a difference between the actual value and the estimated value, wherein said charge indicator represents the level of refrigerant within the system.

11. The method as recited in claim 10, comprising the step of determining a vector quantity representing the difference between estimated parameter values and actual parameter values, and combining the vector quantity representing system reaction with the vector quantity representing the difference between estimated parameter values and actual parameter values to obtain said charge indicator.

12. A method of predicting refrigerant amount within a refrigerant system comprising the steps of:

a) determining a charge indicator representing a current amount of refrigerant within the system based on a difference between an actual value and an estimated value;

b) determining a change value indicative of a rate of change in refrigerant level based on previous values of the charge indicator; and c) predicting a future value of the charge indicator by combining the current charge indicator value with the change value, wherein the future value of the charge indicator is determined for each charge indicator at a predetermined time interval.

13. The method as recited in claim 12, comprising assigning a confidence level to each future value of the charge indicator.

14. The method as recited in claim 13, comprising the steps of determining an estimated future value of the charge value based on the confidence level for each future value and the confidence level assigned to each charge indicator.

15. A heat pump system comprising:

a refrigerant circuit containing a quantity of refrigerant;

a compressor for circulating said refrigerant;

a heat exchanger for transferring thermal energy from said refrigerant;

an expansion valve for controlling flow of refrigerant through said refrigerant circuit, wherein said expansion valve includes an opening variable responsive to a number of current pulses; and a controller monitoring refrigerant level within said refrigerant circuit, said controller operable to estimate a number of current pulses indicative of current refrigerant level, measure an actual number of current pulses and determine a charge indicator based on a difference between said actual number of current pulses and said estimated number of current pulses.

16. The system as recited in claim 15, wherein said estimated value comprises an estimated number of current pulses and said controller determines said estimated number of current pulses in view of a refrigerant discharge pressure and a refrigerant mass flow.

17. The system as recited in claim 15, wherein said estimated value comprises an estimated number of current pulses and said controller determines said estimated number of current pulses in view of refrigerant discharge pressure and a speed of a cooling fan.

18. The system as recited in claim 15, wherein said controller determines a future quantity of refrigerant within said refrigerant circuit based on a current value of said refrigerant.

* * * * *